US006553651B2

(12) United States Patent
Reznik et al.

(10) Patent No.: US 6,553,651 B2
(45) Date of Patent: Apr. 29, 2003

(54) METHOD FOR FABRICATING A PERMANENT MAGNETIC STRUCTURE IN A SUBSTRATE

(75) Inventors: Svetlana Reznik, Rochester, NY (US); Bryan A. Beaman, Churchville, NY (US); Edward P. Furlani, Lancaster, NY (US)

(73) Assignee: Eastman Kodak Company, Rochester, NY (US)

( * ) Notice: Subject to any disclaimer, the term of this patent is extended or adjusted under 35 U.S.C. 154(b) by 106 days.

(21) Appl. No.: 09/803,851

(22) Filed: Mar. 12, 2001

(65) Prior Publication Data

US 2002/0124384 A1 Sep. 12, 2002

(51) Int. Cl.[7] ..... H01F 3/08

(52) U.S. Cl. ..... 29/608

(58) Field of Search ..... 29/606, 607, 608

(56) References Cited

U.S. PATENT DOCUMENTS 5,243,752 A * 9/1993 Moore et al. ..... 148/101

* cited by examiner

*Primary Examiner*—Gregory L. Huson
*Assistant Examiner*—Peter deVore
(74) *Attorney, Agent, or Firm*—Peyton C. Watkins

(57) ABSTRACT

A method for fabricating a permanent magnetic structure in a substrate, the method comprises the steps of providing a substrate with at least one cavity; providing magnetic particles dispersed with a bonding material for forming a bonding compound; filling the cavities with the bonding compound; and curing the compound to form the permanent magnetic structure in the substrate.

7 Claims, 3 Drawing Sheets

METHOD FOR FABRICATING A PERMANENT MAGNETIC STRUCTURE IN A SUBSTRATE

FIELD OF THE INVENTION

The invention relates generally to the field of magnetization and, more particularly, to substrates having cavities which contain a magnetized compound.

BACKGROUND OF THE INVENTION

Advances in micro-systems technology have spawned the rapid development of a variety of devices for both research and commercial use. These devices include accelerometers, light modulators, micro-fluidic devices, micro-motors, molecular filters and various actuators and sensors. To date, the majority of MEMS actuators have been electro-statically driven. There are at least two reasons for this. First, electrostatic activation is compatible with standard microelectronic fabrication methods. Secondly, the electrostatic force scales relatively well at the micro-domain. Specifically, if the electric field is kept constant, the electrostatic force scales as $L^2$, where L is the characteristic dimension of the device. Thus, if the size of the device is decreased by ten, the electrostatic force decreases by a factor of one hundred.

The implementation of magnetically actuated MEMS devices is much less developed then the electrostatic case. One reason for this is that the magnetic force for current driven devices scales as $L^4$ when the current density is kept constant. This is two orders of magnitude weaker than the electrostatic case. This disadvantage can be overcome if permanent magnets are used. Specifically, if all the linear dimensions of a permanent magnet are reduced, the field strength at all the re-scaled observation points remains constant (assuming that the magnetization is constant). Moreover, there is no power consumption. However, few if any methods exist for producing integrated permanent magnet structures for use in MEMS devices.

Therefore, a need exists for a practical method for fabricating permanent magnet structures on the order of 10 to 100s of microns on a substrate for use as a field source in a MEMS device. More specifically, there exists a need for such a method that can be adapted for the batch processing in which tens to hundreds of devices can be simultaneous fabricated on a single silicon wafer.

SUMMARY OF THE INVENTION

A method for fabricating a permanent magnetic structure in a substrate, the method comprises the steps of: (a) providing a substrate with at least one cavity; (b) providing magnetic particles dispersed with a bonding material for forming a bonding compound; (d) filling the cavities with the bonding compound; and (e) curing the compound to form the permanent magnetic structure in the substrate.

BRIEF DESCRIPTION OF THE DRAWINGS

The above and objects, features and advantages of the present invention will become apparent when taken in conjunction with the following description and drawings wherein identical reference numerals have been used, where possible, to designate identical features that are common to the figures, and wherein.

DETAILED DESCRIPTION OF THE INVENTION

Figure 1:
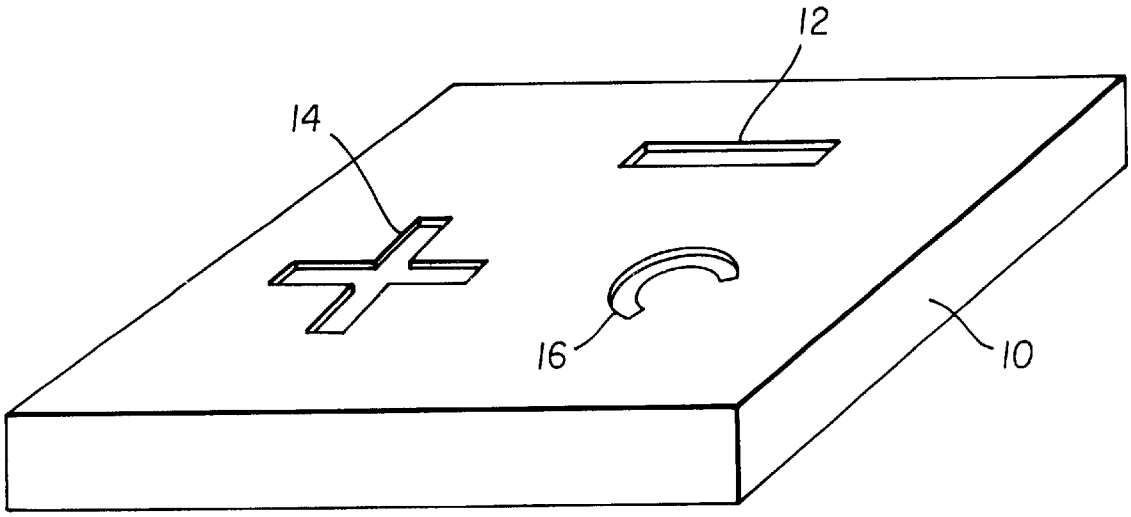
FIG. 1 is a perspective of a substrate with micromachined recesses.

Referring to FIG. 1, there is shown a perspective view of a silicon substrate 10 having a plurality of recesses 12, 14, 16 that may range from 10 to 100' of microns. The recess may have a variety of shapes, for example a cross-shape 14, arcuate 16, linear 12 and the like.

Figure 2:
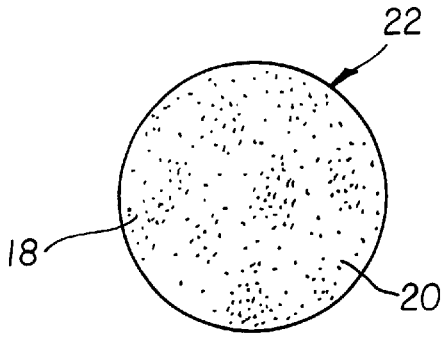
FIG. 2 is a view of a magnetic particle that is to be embedded in a the recesses in the substrate.

Referring to FIG. 2, there is shown a view of a magnetic particle 18 for filling the cavities, as described in detail hereinbelow. The magnetic particle 18 is preferable ferric oxide ($Fe_2O_3$), and the particle size is preferably from 1 to 5 microns. The magnetic particle 18, preferably Hc of 315 Oe (approximately 40% ferrite) doped with Co is mixed with bonding compound for forming a magnetizable-bonding magnetic compound 22 that adheres to the cavities 12, 14, 16 of the substrate 10 when placed therein.

Figure 3:
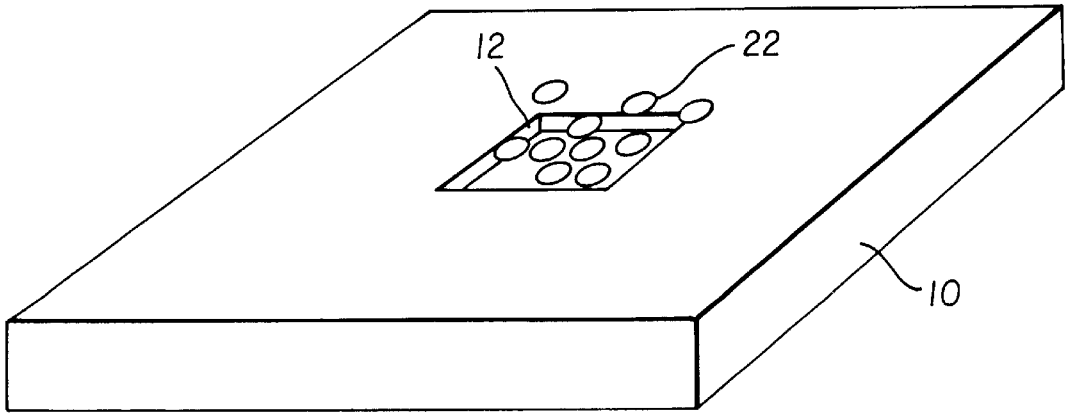
FIG. 3 is a view of a collection of magnetic particles filled in a recess in a substrate.
Figure 4:
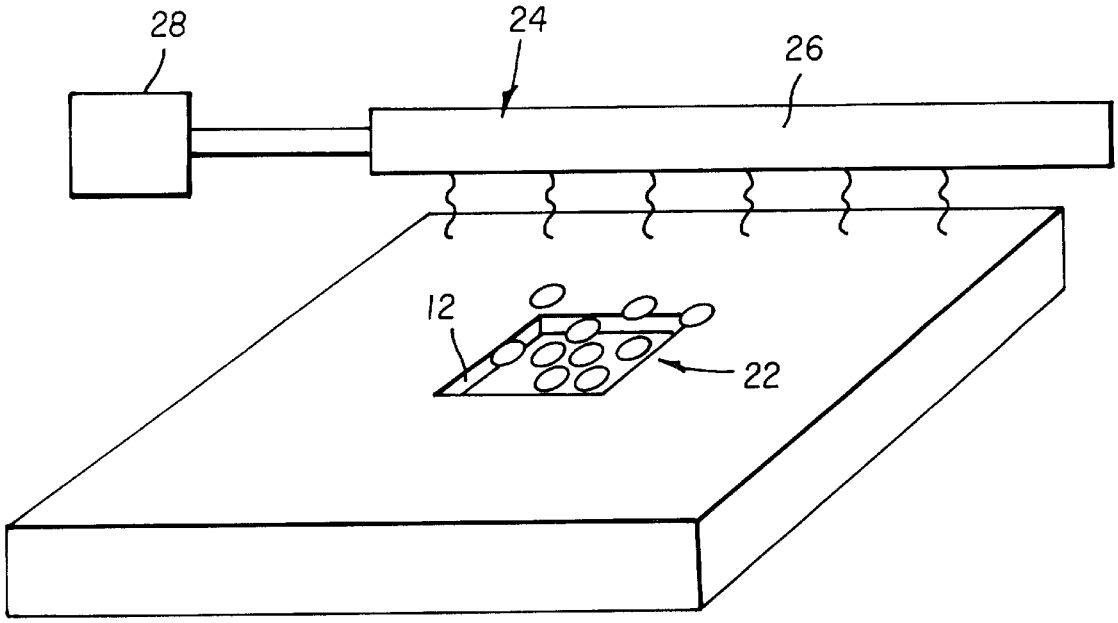
FIG. 4 shows an apparatus for producing ultrasound energy for application to the substrate with the deposited magnetic particles.

In this regard and referring to FIG. 3, there is shown the magnetizable-bonding compound 22 placed in the cavity 12 of the silicon wafer 10. For clarity of illustration, only one of the cavities is shown although there are a plurality of cavities. Referring to FIG. 4, there is shown an ultrasound apparatus 24 having a transducer 26 and a power supply 28 which, when energized, causes the transducer 26 to apply ultrasound energy to the substrate 10 having the deposited compound 22. This causes the compound 22 to be compactly placed in the cavity 12. After the compound 22 are packaged into the cavity 12, the compound is fused in the wafer cavities preferably at 200 degrees C. for 0.5 to 1 seconds depending on the size of the cavity.

Figure 5:
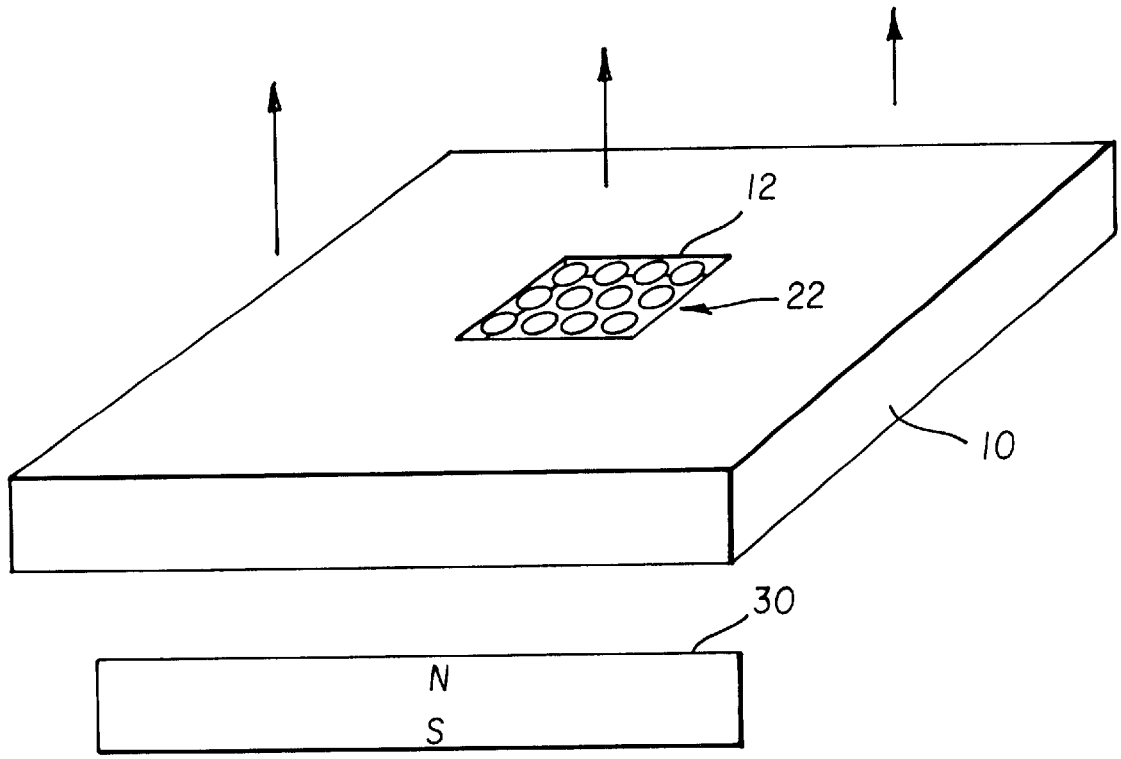
FIG. 5 shows a process for magnetizing the magnetic particles once they are embedded.

Referring to FIG. 5, there is shown the magnetizing process of the imbedded compound 22. A permanent magnet 30 is used to polarize the particles 18 of the compound 22 in a pre-determined preferred orientation. Alternatively, magnetic heads or electromagnetic coils could used be also. The magnetic field could be applied before or after the fusing of the compound 22.

Therefore, the invention has been described with reference to a preferred embodiment. However, it will be appreciated that variations and modifications can be effected by a person of ordinary skill in the art without departing from the scope of the invention.

PARTS LIST

10 substrate
12 linear recess
14 cross-shape recess
16 arcuate recess
18 magnetic particle
20 cobalt (Co)
22 magnetizable-bonding compound
24 ultrasound apparatus
26 transducer
28 power supply
30 permanent magnet

What is claimed is:

1. A method for fabricating a permanent magnetic structure in a substrate, the method comprising the steps of:

(a) providing a substrate with at least one cavity substantially between 10 to 100 microns;

(b) providing magnetic particles dispersed with a bonding material for forming a bonding compound;

(c) filling the cavities with the bonding compound;

(d) compacting the bonding compound for creating a higher density bonding compound; and (e) curing the compound to form the permanent magnetic structure in the substrate.

2. The method as in claim 1 further comprising the step of magnetizing the cured compound.

3. The method as in claim 1, wherein step (b) includes providing bonded magnetic particles with Hc of 315 Oe doped with Co.

4. The method as in claim 1, wherein step (c) includes curing the compound at substantially 200 degrees C.

5. The method as in claim 4, wherein step (c) includes curing the compound at substantially 0.5 to 1 second.

6. The method as in claim 1, wherein step (a) includes providing either an arcuate-shaped cavity, an cross-shaped cavity, or a linear-shaped cavity.

7. The method as in claim 6 further comprising providing a plurality of cavities each of which may be arcuate-shaped, cross-shaped, or linear-shaped.

* * * * *